US005341897A

United States Patent [19]

Gross

[11] Patent Number: 5,341,897

[45] Date of Patent: Aug. 30, 1994

[54] COLLAPSIBLE AND RETRACTABLE STEP APPARATUS

[76] Inventor: Charles E. Gross, 1030 Whippingham Parkway, Carrollton, Va. 23314

[21] Appl. No.: 147,304

[22] Filed: Nov. 5, 1993

[51] Int. Cl.[5] ..... A47B 77/10

[52] U.S. Cl. ..... 182/88; 182/35; 182/91; 312/235.1

[58] Field of Search ..... 182/88, 91, 35, 85, 182/86, 97, 35, 129; 312/235.1

[56] References Cited

U.S. PATENT DOCUMENTS 3,481,429 12/1969 Gaede ..... 182/88
3,743,320 7/1973 Clark ..... 182/91 X
4,846,304 7/1989 Rasmussen ..... 182/88

*Primary Examiner*—Alvin C. Chin-Shue
*Attorney, Agent, or Firm*—Peter J. Van Bergen

[57] ABSTRACT

A collapsible and retractable step apparatus having first and second steps is provided. The steps are extendable from, and used in combination with, a shelf that resides a vertical distance above a floor. A support and suspension leg unit is free at a first end thereof and is rotationally secured at a second end thereof to the second step. The leg unit is also rotationally secured to the first step at a location between the first and second ends of the leg unit. The leg unit positions and supports the first and second steps in a first configuration in which the first and second steps are positioned along with the leg unit in a substantially contiguous plane. The leg unit is rotatable about the location between the first and second ends of the leg unit to a second configuration in which the leg unit is in a substantially vertical orientation with respect to the floor. In the second configuration, the first or free end of the leg unit rests on the floor such that the leg unit supports the first step. The second end of the leg unit suspends the second step above the first step. The second step is rotatable about the second end of the leg unit such that the leg unit supports the second step substantially parallel to the first step. A mounting unit is secured with respect to the shelf for operatively receiving the first and second steps along with the leg unit in the first configuration. The mounting unit also supports the first step in the second configuration.

20 Claims, 7 Drawing Sheets

COLLAPSIBLE AND RETRACTABLE STEP APPARATUS

FIELD OF THE INVENTION

The invention relates generally to folding steps, and more particularly to collapsible and retractable steps used in conjunction with shelf or cabinet structures.

BACKGROUND OF THE INVENTION

Small children are frequently unable to reach a kitchen or bathroom sink or countertop. Children and adults alike are frequently unable to reach items stored in a kitchen's upper shelves and cabinets. To date, the solution to these problems runs the gamut from simple stepping stools to specifically designed retractable step devices for use in conjunction with an existing structural element such as a cabinet. However, these devices are complex and must often be manufactured as an integral component of the existing (cabinet) structure. Such designs are too costly for most households. As a result, the simple stepping stool or the act of climbing on top of a counter remain as the standard in most households.

SUMMARY OF THE INVENTION

Accordingly, it is an object of the present invention to provide a retractable folding step apparatus for installation in existing shelf or cabinet structures without any modification of the shelf or cabinet structure.

Another object of the present invention is to provide a retractable folding step apparatus that minimizes the space required for storing same in an existing shelf or cabinet structure.

Still another object of the present invention is to provide a collapsible and retractable step apparatus that is simple in construction, economical to manufacture and safe in use.

Yet another object of the present invention is to provide a collapsible and retractable step apparatus that is supported by using the existing shelf or cabinet structure as well as the floor supporting the existing structure.

Other objects and advantages of the present invention will become more obvious hereinafter in the specification and drawings.

In accordance with the present invention, a step apparatus having first and second steps is provided. The steps are extendable from and used in combination with a shelf that resides a vertical distance above a floor. A support and suspension leg unit is free at a first end thereof and is rotationally secured at a second end thereof to the second step. The leg unit is also rotationally secured to the first step at a location between the first and second ends of the leg unit. The leg unit positions and supports the first and second steps in a first configuration in which the first and second steps are positioned along with the leg unit in a substantially contiguous plane. The leg unit is rotatable about the location between the first and second ends of the leg unit to a second configuration in which the leg unit is in a substantially vertical orientation with respect to the floor. The first or free end of the leg unit rests on the floor such that the leg unit supports the first step. The second end of the leg unit suspends the second step above the first step. The second step is rotatable about the second end of the leg unit such that the leg unit supports the second step substantially parallel to the first step. A mounting unit is secured with respect to the shelf for operatively receiving the first and second steps along with the leg unit in the first configuration. The mounting unit also supports the first step in the second configuration.

DETAILED DESCRIPTION OF THE INVENTION

Figure 1A:
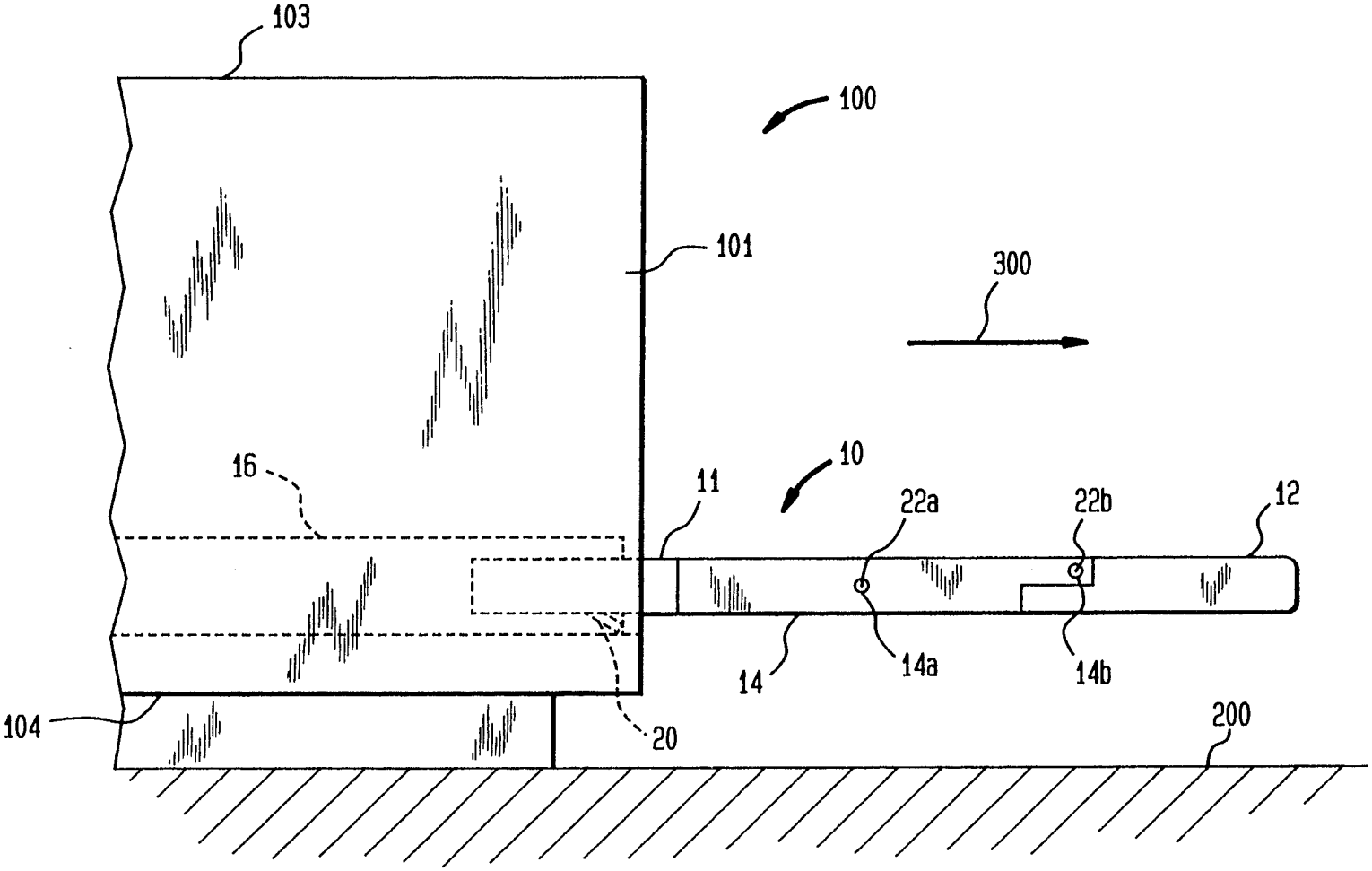
FIG. 1A is a side view of the present invention extending in its collapsed configuration from a typical kitchen or bathroom cabinet environment.
Figure 1B:
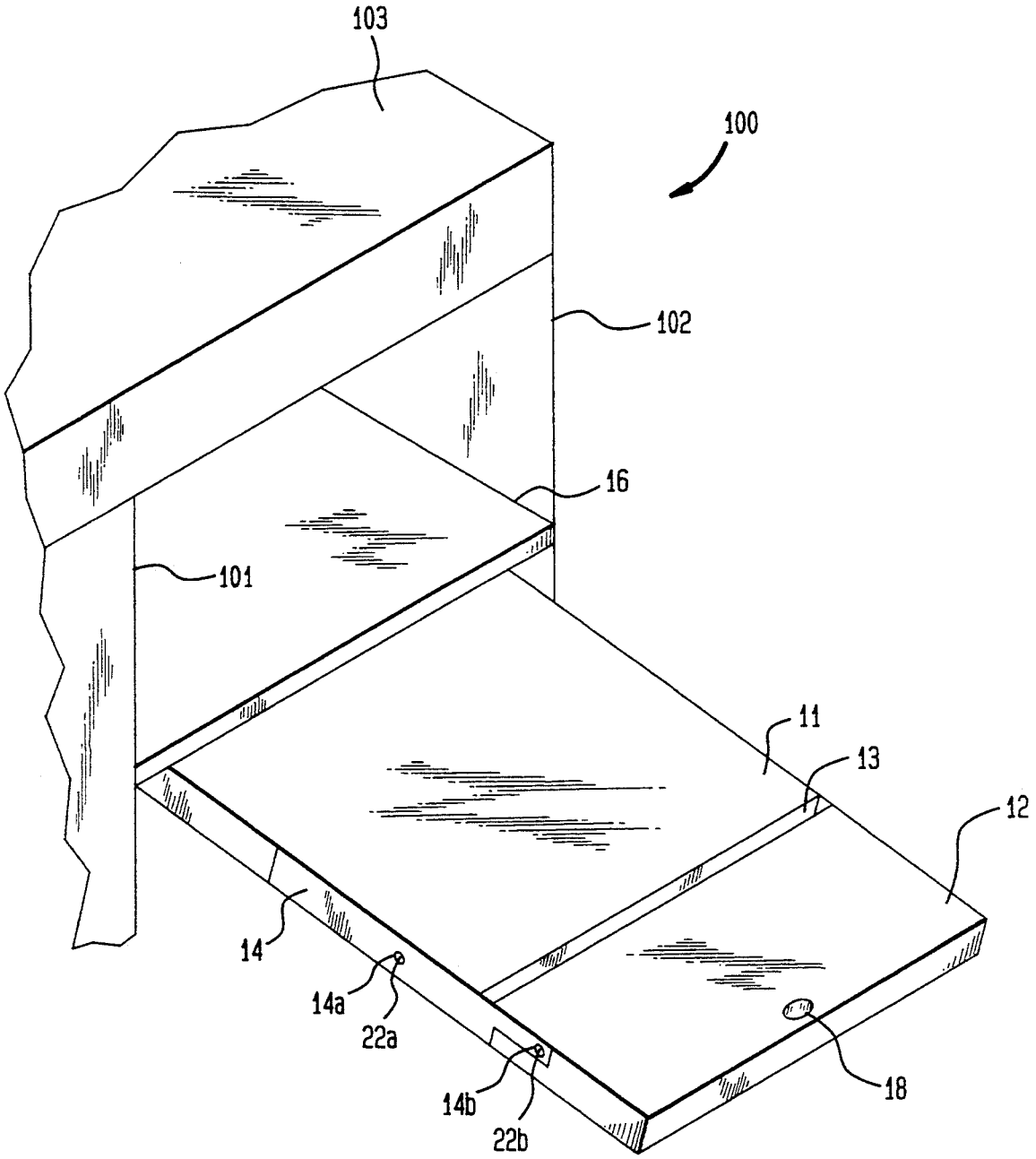
FIG. 1B is a perspective view of the present invention extending in its collapsed configuration from the kitchen or bathroom cabinet environment.
Figure 2A:
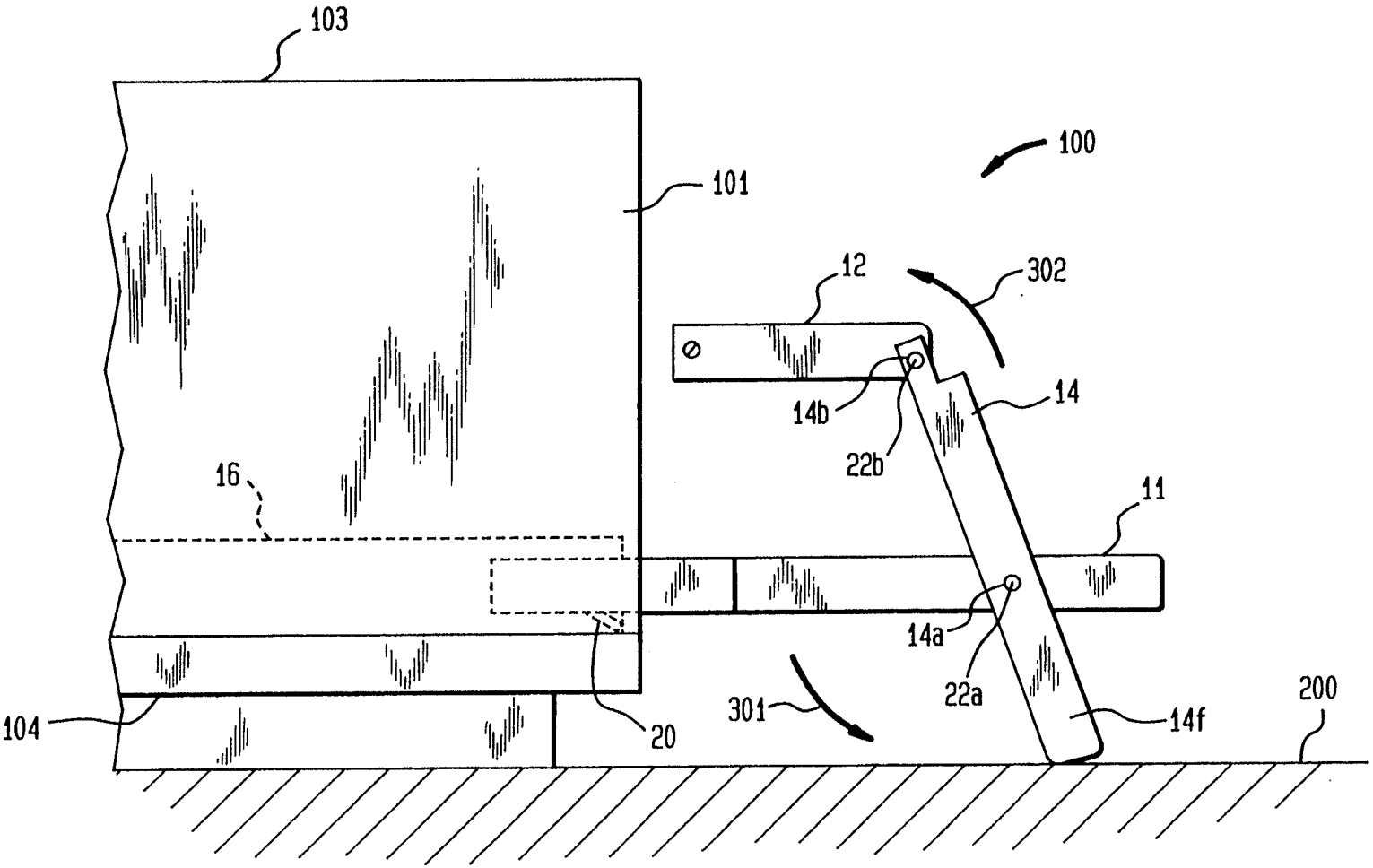
FIG. 2A is a side view of the present invention extending in its opened configuration from the kitchen or bathroom cabinet environment.
Figure 2B:
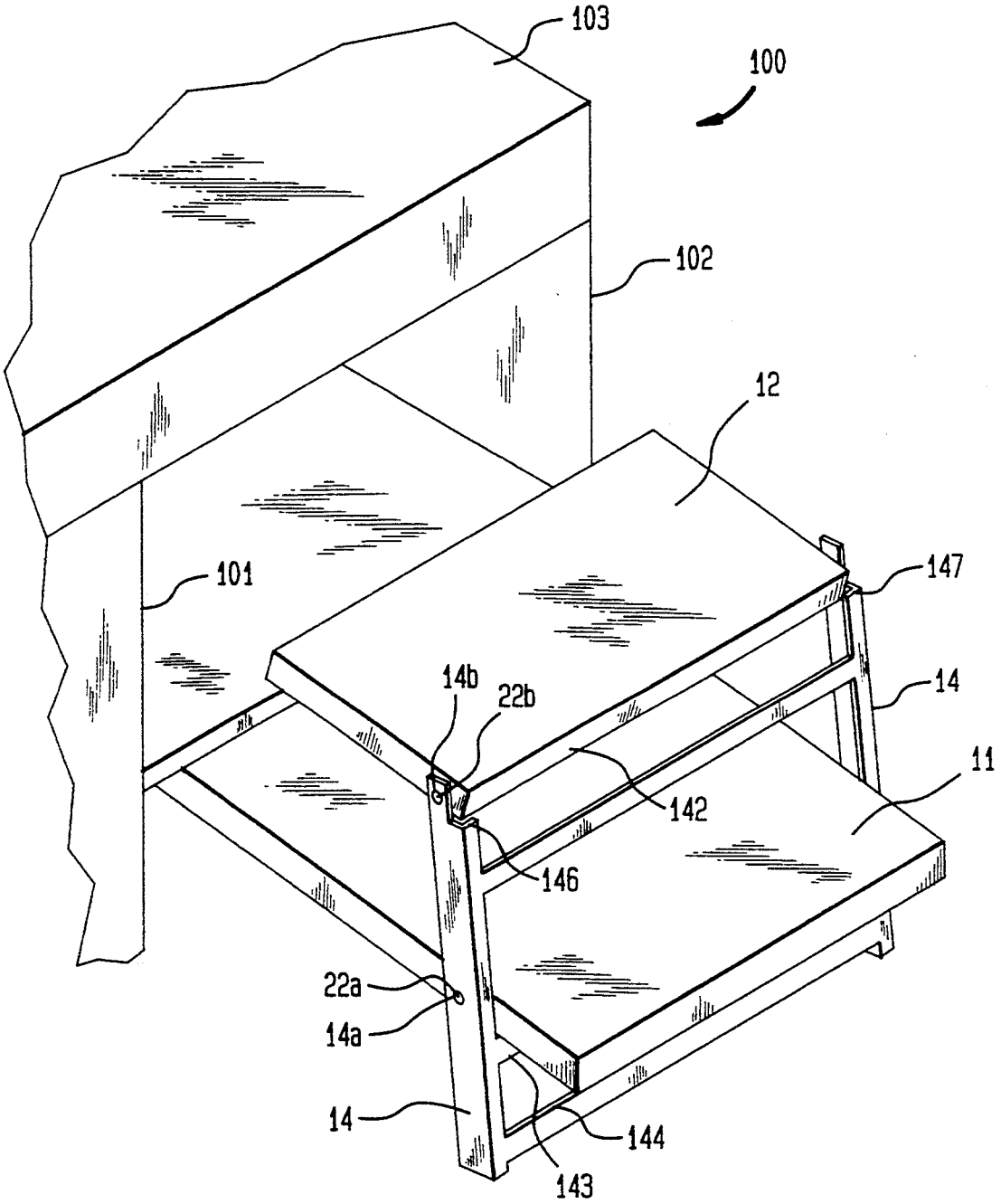
FIG. 2B is a perspective view of the present invention extending in its opened configuration from the kitchen or bathroom cabinet environment.

Referring now to the drawings, and more particularly to FIGS. 1A, 1B, 2A and 2B, the collapsible and retractable step apparatus of the present invention is shown deployed in its collapsed or first configuration (FIGS. 1A and 1B) and in its opened or second configuration (FIGS. 2A and 2B). More specifically, FIGS. 1A and 2A are side views, and FIGS. 1B and 2B are perspective views of the respective configurations. Like reference numerals will be used for common elements in each of the drawings.

By way of example, step apparatus 10 is shown installed in an existing cabinet structure 100 having side walls 101 and 102, top 103 and a bottom shelf or cabinet floor 104 that is typically a height of 4–6 inches above the supporting floor 200. Cabinets of this sort are typically found in kitchens, bathrooms, workshops, etc. of both residential and commercial buildings. However, it is to be understood that a variety of other existing structures may provide the necessary installation support for the present invention. For example, step apparatus 10 might also be used in conjunction with a shelf or other vertical support structure as opposed to a cabinet. The only requirement is that step apparatus 10 be supported a vertical distance above a support floor. This vertical distance forms the height of the first step. As will be readily apparent to one of ordinary skill in the art, step apparatus 10 may be designed for a variety of such vertical distances, but is generally limited by the existing installation structure and the ability of the user to comfortably step up to such vertical distance.

Step apparatus 10 consists of a first step 11, a second step 12, and a support and suspension leg unit 14 that connects first step 11 to second step 12 at locations **14*a* and 14*b*, respectively. In addition, step apparatus 10 includes a mounting unit 16 installed in cabinet 100. While more detail of mounting unit 16 will be provided below, it is sufficient at this point in the description to say that mounting unit 16 provides the means for receiving steps 11 and 12 along with leg unit 14 in their first configuration, and for partially supporting steps 11 and 12 in their second configuration. Mounting unit 16 is fixably secured within cabinet 100** by any one of a variety of conventional fastening means (e.g., screws, nails, glue, etc.).

The basic operation of step apparatus 10 will now be described. Step apparatus 10 is pulled (as indicated by arrow 300) by a user from its retracted position within mounting unit 16 to its deployed first configuration shown in FIGS. 1A and 1B. To facilitate removal of steps 11 and 12 along with leg unit 14 from mounting unit 16, a finger or toe hold 18 may be provided in the outermost end of second step 12. Such finger or toe hold 18 may be implemented by means of a hole, indentation, handle, etc. and is not a limitation of the present invention.

In the first configuration, steps 11 and 12 are contiguous with one another in a single plane. Leg unit 14 is also aligned in the plane defined by steps 11 and 12 and, as will be described further below, can provide the structure for aligning steps 11 and 12 in both the first and second configurations. When deployed in the first configuration, mounting unit 16, in conjunction with cabinet 100, provides a basic level of vertical support Accordingly a portion 11*a* of step 11 remains within mounting unit 16. To ensure that portion 11*a* is sufficient to provide such support, and to further prevent a user from pulling steps 11 and 12 along with leg unit 14 completely from mounting unit 16, a mechanical stop mechanism 20 is provided. Stop mechanism 20 may comprise any one of a variety of well known mechanisms that cooperate between step 11 and either some portion of mounting unit 16 or some portion of cabinet 100. Thus, the choice of stop mechanism 20 is not a limitation of the present invention.

From its first configuration, step apparatus 10 is easily converted to the second configuration shown in FIGS. 2A and 2B. Specifically, leg unit 14 is rotated about location 14*a* in the direction of arrow 301 such that free end 14*f* of leg unit 14 comes to rest on supporting floor 200. Second step 12 is rotated about location 14*b* in the direction of arrow 302 such that second step 12 is offset or vertically staggered from first step 11 in a step ladder configuration (i.e. , steps 11 and 12 are substantially parallel with one another). Thus, second step 12 experiences a cumulative rotation of approximately 180° between the first and second configurations.

To provide for the above described rotation, locations 14*a* and 14*b* must hinge as shown. While this may be implemented in a variety of ways, pins 22*a* and 22*b* are shown by way of example to rotationally secure first step 11 to leg unit 14 and second step 12 to leg unit 14. Since leg unit 14 supports first step 11 and second step 12 under loaded conditions, structural support must be provided to maintain the second configuration. One way of achieving this is to incorporate the second configuration's support function in leg unit 14 as shown in FIGS. 3A and 3B where leg unit 14 appears in isolation.

Figure 3A:
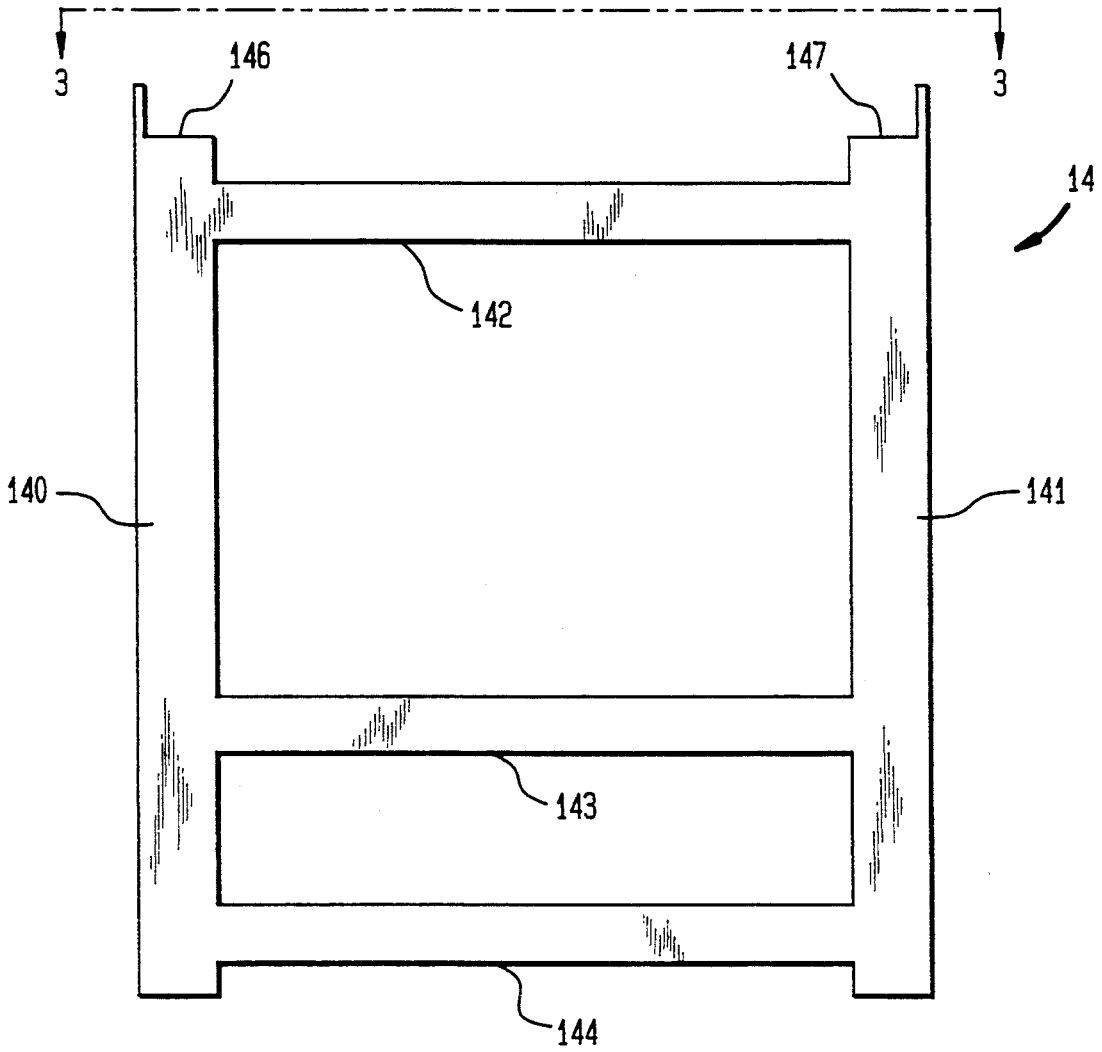
FIG. 3A is a head-on view of the preferred embodiment leg unit shown in isolation.
Figure 3B:
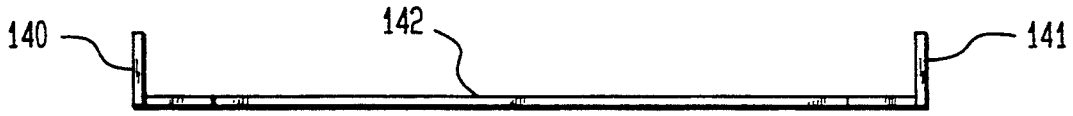
FIG. 3B is a cross sectional view along line 3—3 of FIG. 3A.

In FIGS. 3A and 3B, leg unit 14 consists of two right angled leg elements 140 and 141 maintained in a substantially parallel relationship by cross members 142, 143 and 144. Cross members 142, 143 and 144 are shown to be integral with leg elements 140 and 141. Alternatively, cross members 142, 143 and 144 may be attached to leg elements 140 and 141. In addition to strengthening leg unit 14, cross members 143 and 144 limit rotation of leg unit 14 about location 14*a*. More specifically, in the first configuration, cross member 144 prevents rotation of leg unit 14 beyond the contiguous plane defined by steps 11 and 12 and shown in FIGS. 1A and 1B. In the second configuration, cross member 143 prevents rotation of leg unit 14 beyond the substantially vertical position of leg unit 14 shown in FIGS. 2A and 2B.

To minimize the height of leg unit 14, each cross member 142, 143 and 144 is preferably integral with (e.g., welded to) leg elements 140 and 141 as shown in the cross-section of FIG. 3B which is taken along line 3—3 of FIG. 3A. Further, to minimize the height of steps 11 and 12 along with leg unit 14 in the first configuration, step 11 can be configured with grooves or channels (not shown) spanning the width of step 11 for receiving cross members 143 and 144 when step apparatus 10 is in the first configuration. Cross member 142 resides in a gap 13 between steps 11 and 12 (FIG. 1B) in their first configuration.

In order to permit rotation of second step 12 about location 14*b*, leg elements 140 and 141 are provided with respective notches 146 and 147. Further, in order to limit rotation of second step 12 about location 14*b* and support second step 12 in the second configuration, second step 12 is let into leg elements 140 and 141 such that as it rotates in accordance with the direction of arrow 302, it comes to rest against leg elements 140 and 141 just below notches 146 and 147 as is evident in FIG. 2B.

It will be readily recognized and understood by one of ordinary skill in the art that the above described rotation limitation and support aspect of leg unit 14 may be provided in a variety of other manners without departing from the scope of the present invention. For example, another approach would be to provide hinges (not shown) mounted between each step 11 and 12 and leg unit 14, that permitted only the range of rotation shown in FIG. 2A. Further, although leg unit 14 has been shown using vertical elements disposed on either side of step apparatus 10, the present invention is not so limited. For example, depending on the overall width of step apparatus 10, materials used to build same and the expected load, leg unit 14 might be implemented from only one side of the step apparatus in which case the first and second steps would be cantilevered therefrom.

Figure 4:
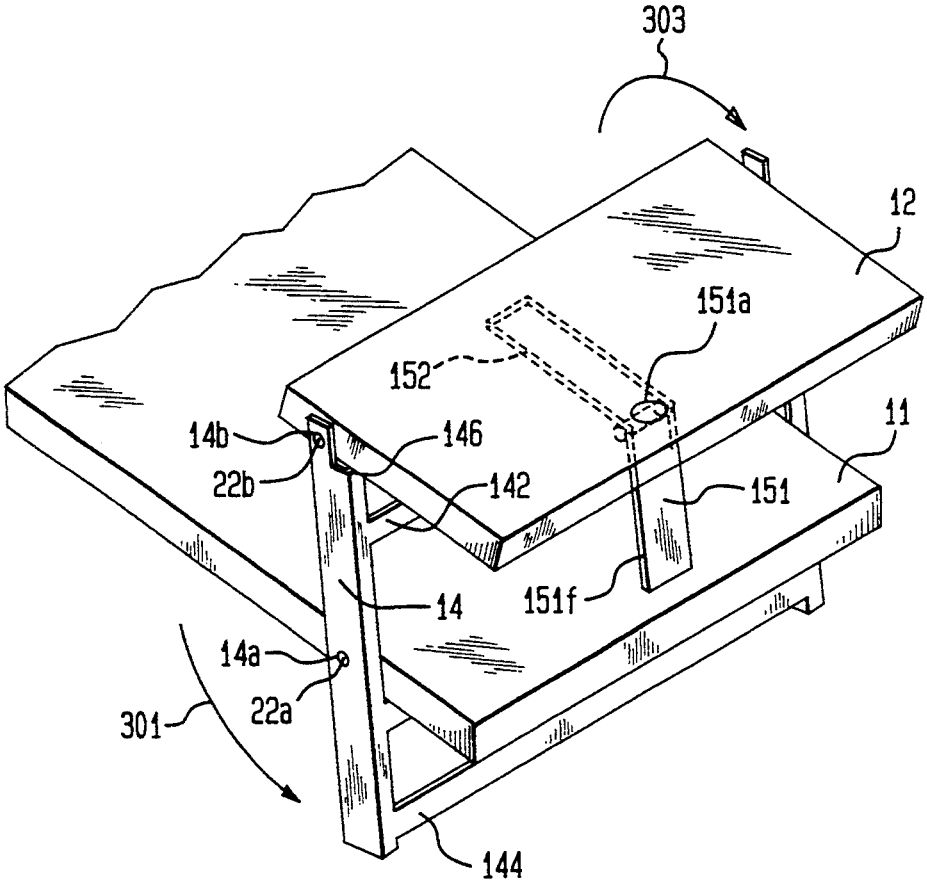
FIG. 4 is a perspective view of an alternative embodiment of the present invention shown in its opened configuration.

In addition to the above alternatives, yet another possibility is to provide a leg unit that permits rotation of second step 12 about location 14*b* in a direction that is opposite to the direction of rotation of leg unit 14 about location 14*a* as shown in FIG. 4. In FIG. 4, notches 146 and 147 are cut sufficiently into leg elements 140 and 141 to permit rotation of second step 12 in the direction of arrow 303 which is opposite to the direction of arrow 301. Thus, second step 12 experiences a cumulative rotation of approximately 0° between the first and second configurations. The resulting second configuration provides a first step 11/second step 12 arrangement that is more vertically aligned than that shown in the previous embodiment. Such an arrangement may be desirable in certain limited space installations.

To support second step 12 in its second configuration, the embodiment of FIG. 4 can include one or more vertical or angle supports. By way of illustrative example, a vertical support 151 is shown. Vertical support 151 hinges downward from a slot in second step 12 at location 151*a* so that its free end 151*f* comes to rest on first step 11. Slot 152 can be cut across second step 12 as shown or can run along the length of second step 12 depending on the length of support 151. Further, as in the preferred embodiment, the embodiment of FIG. 4 might also be achieved by a hinge(s) (not shown) mounted between second step 12 and leg unit 14 to permit only the range of motion shown in FIG. 4.

Figure 5:
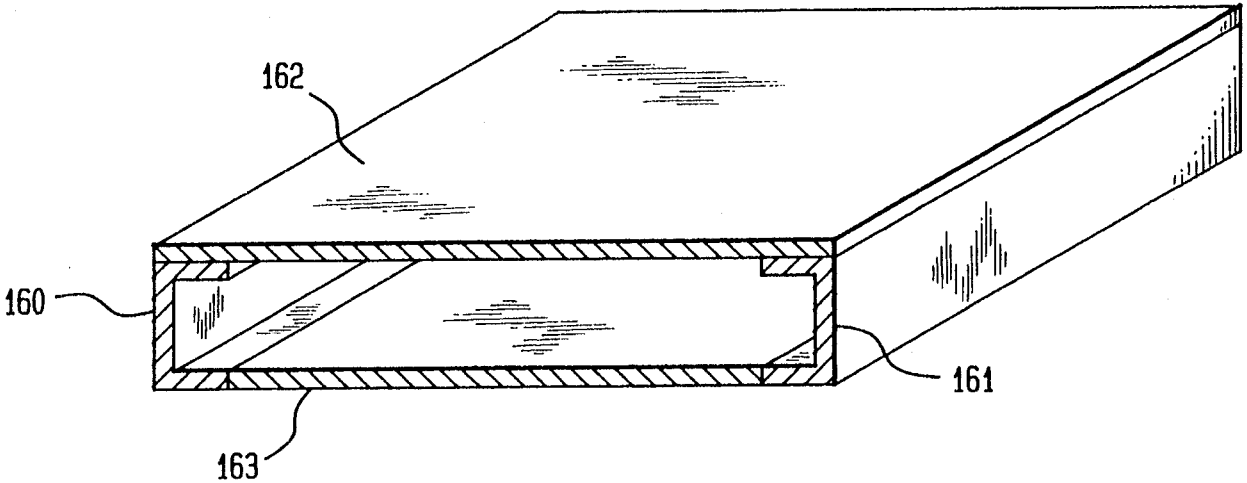
FIG. 5 is a perspective view of the mounting unit of the present invention.

As mentioned above, mounting unit 16 is secured to the existing cabinet (or other supporting) structure 100 in any one of a variety of well known manners. Although shown mounted on or above cabinet floor 104, mounting unit 16 might also be secured below the existing structure's shelf provided there is room. In its simplest embodiment shown in FIG. 5, mounting unit 16 consists of two C-channel elements 160 and 161 parallel to and opposing one another as shown and running the length of mounting unit 16. Right angled elements 140 and 141, forming the exterior of step apparatus 10, slidingly fit within channels 160 and 161. Top plate 162 may be provided to tie the upper portion of channels 160 and 161 together and further enclose the top of step apparatus 10. Top plate 162 is particularly useful when installation is to occur on or above a cabinet floor (or other existing support structure). In this way, top plate 162 replaces the shelf space occupied by step apparatus 10. The lower portion of channels 160 and 161 are held in place by conventional cross supports of which support 163 is shown as being representative. Note that support 163 may also serve as the means for cooperating with stop mechanism 20 shown and described above with reference to FIGS. 1A and 2A.

The advantages of the present invention are numerous. The step apparatus of the present invention is deployed from a compact retracted position and is easily manipulated to form two steps. The entire apparatus is self-contained and may be installed in a variety of new and existing support structures without any modification thereof. The design is simple and may be produced from a wide variety of materials in a wide variety of manners without departing from its inventive principles.

Although the invention has been described relative to specific embodiments thereof, there are numerous other variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A step apparatus extendable from and in combination with a shelf that resides a vertical distance above a floor, comprising:

a first step defining a first horizontal surface;

a second step defining a second horizontal surface;

a support and suspension leg unit free at a first end thereof and rotationally secured at a second end thereof to said second step, said leg unit further rotationally secured to said first step at a location between said first and second ends;

said leg unit positioning and supporting said first and second steps in a first configuration in which said first and second horizontal surfaces lie adjacent one another in a non-overlapping fashion;

said leg unit rotatable about said location between said first and second ends for positioning and supporting said first and second steps in a second configuration in which said leg unit is in a substantially vertical orientation with respect to said floor, said first end resting on said floor such that said leg unit supports said first step, said second end suspending said second step above said first step, said second step rotatable about said second end such that said leg unit supports said second step substantially parallel to said first step; and a mounting unit secured with respect to said shelf for operatively receiving said first and second steps and said leg unit in said first configuration and for supporting said first step in said second configuration.

2. A step apparatus as in claim 1 wherein said mounting unit is secured above said shelf, said mounting unit further including a top plate maintained above and substantially parallel to said shelf.

3. A step apparatus as in claim 1 further comprising a stop mechanism cooperating between said first step and said mounting unit for maintaining a portion of said first step within said mounting unit when said step apparatus is extended from said shelf in said first and second configurations.

4. A step apparatus as in claim 1 further comprising a stop mechanism cooperating between said first step and said shelf for maintaining a portion of said first step within said mounting unit when said step apparatus is extended from said shelf in said first and second configurations.

5. A step apparatus as in claim 1 wherein said leg unit includes first and second leg elements disposed on opposing sides of said first and second steps.

6. A step apparatus as in claim 5 wherein said first and second leg elements are substantially parallel to one another.

7. A step apparatus as in claim 1 wherein said leg unit and said second step are rotatable in the same direction, wherein said second step undergoes a cumulative rotation of approximately 180° between said first and second configurations.

8. A step apparatus as in claim 7 wherein said second step is vertically staggered from said first step in said second configuration.

9. A step apparatus as in claim 1 wherein said leg unit and said second step are rotatable in the opposite direction, wherein said second step undergoes a cumulative rotation of approximately 0° between said first and second configurations.

10. A step apparatus extendable from and in combination with a shelf that resides a vertical distance above a floor, comprising:

a first step defining a first horizontal surface;

a second step defining a second horizontal surface;

a support and suspension leg unit free at a first end thereof and rotationally secured at a second end thereof to said second step, said leg unit further rotationally secured to said first step at a location between said first and second ends;

a first rotational limiter cooperating between said leg unit and said first step for limiting rotational movement of said leg unit about said location between said first and second ends;

a second rotational limiter cooperating between said leg unit and said second step for limiting rotational movement of said second step about said second end wherein, in a first configuration, said first and second horizontal surfaces lie adjacent one another in a non-overlapping fashion, and wherein, in a second configuration, said leg unit rotates about said location between said first and second ends such that said first rotational limiter maintains said leg unit in a substantially vertical orientation with respect to said floor, said first end resting on said floor such that said leg unit supports said first step, said second end suspending said second step above said first step, and said second step rotates about said second end such that said second rotational limiter maintains said second step substantially parallel to said first step as said leg unit supports said second step; and a mounting unit secured with respect to said shelf for operatively receiving said first and second steps and said leg unit in said first configuration and for supporting said first step in said second configuration.

11. A step apparatus as in claim 10 wherein said mounting unit is secured above said shelf, said mounting unit further including a top plate maintained above and substantially parallel to said shelf.

12. A step apparatus as in claim 10 further comprising a stop mechanism cooperating between said first step and said mounting unit for maintaining a portion of said first step within said mounting unit when said step apparatus is extended from said shelf in said first and second configurations.

13. A step apparatus as in claim 10 further comprising a stop mechanism cooperating between said first step and said shelf for maintaining a portion of said first step within said mounting unit when said step apparatus is extended from said shelf in said first and second configurations.

14. A step apparatus as in claim 10 wherein said leg unit includes first and second leg elements disposed on opposing sides of said first and second steps.

15. A step apparatus as in claim 14 wherein said first and second leg elements are substantially parallel to one another.

16. A step apparatus as in claim 10 wherein said leg unit and said second step are rotatable in the same direction, wherein said second step undergoes a cumulative rotation of approximately 180° between said first and second configurations.

17. A step apparatus as in claim 16 wherein said second step is vertically staggered from said first step in said second configuration.

18. A step apparatus as in claim 10 wherein said leg unit and said second step are rotatable in the opposite direction, wherein said second step undergoes a cumulative rotation of approximately 0° between said first and second configurations.

19. A step apparatus as in claim 10 wherein said first rotational limiter is integral with said leg unit.

20. A step apparatus as in claim 10 wherein said second rotational limiter is integral with said leg unit.

* * * * *